US006482311B1

(12) United States Patent
Wickham et al.

(10) Patent No.: US 6,482,311 B1
(45) Date of Patent: Nov. 19, 2002

(54) METHODS FOR SUPPRESSION OF FILAMENTOUS COKE FORMATION

(75) Inventors: David T. Wickham, Boulder; Jeffrey Engel, Golden; Michael E. Karpuk, Boulder, all of CO (US)

(73) Assignee: TDA Research, Inc., Wheat Ridge, CO (US)

( * ) Notice: Subject to any disclaimer, the term of this patent is extended or adjusted under 35 U.S.C. 154(b) by 49 days.

(21) Appl. No.: 09/629,361

(22) Filed: Aug. 1, 2000

(51) Int. Cl.[7] ..... C10G 9/16

(52) U.S. Cl. ..... 208/48 AA; 208/48 R; 585/950

(58) Field of Search ..... 208/48 R, 48 AA; 585/950

(56) References Cited

U.S. PATENT DOCUMENTS

| | | | | |
|---|---|---|---|---|
| 1,847,095 | A | 3/1932 | Mittasch et al. | |
| 2,698,512 | A | 1/1955 | Schirmer et al. | 60/35.4 |
| 2,959,915 | A | 11/1960 | Dille et al. | 60/35.4 |
| 3,173,247 | A | 3/1965 | Smith et al. | 60/35.4 |
| 3,531,394 | A | 9/1970 | Koszman | 208/48 |
| 4,003,829 | A | 1/1977 | Burger et al. | 208/253 |
| 4,024,050 | A | 5/1977 | Shell et al. | 208/48 AA |
| 4,105,540 | A | 8/1978 | Weinland | 208/48 AA |
| 4,166,046 | A | 8/1979 | Eberly, Jr. | 252/439 |
| 4,492,767 | A | 1/1985 | Fung | 502/35 |
| 4,542,253 | A | 9/1985 | Kaplan et al. | 585/650 |
| 4,544,785 | A | 10/1985 | Withers et al. | 585/500 |
| 4,551,227 | A | 11/1985 | Porter et al. | 208/48 AA |
| 4,555,326 | A | 11/1985 | Reid | 208/48 R |
| 4,680,421 | A | 7/1987 | Forester et al. | 585/648 |
| 4,686,201 | A | 8/1987 | Porter et al. | 502/154 |
| 4,692,234 | A | 9/1987 | Porter et al. | 208/48 AA |
| 4,729,064 | A | 3/1988 | Singer, Jr. | 361/426 |
| 4,835,332 | A | 5/1989 | Kisalus | 585/650 |
| 4,863,892 | A | 9/1989 | Porter et al. | 502/170 |
| 4,962,207 | A | 10/1990 | Albeck et al. | 549/334 |
| 5,026,846 | A | 6/1991 | Duchesne | 544/1 |
| 5,093,032 | A | 3/1992 | Reid et al. | 252/400.4 |
| 5,128,023 | A | 7/1992 | Reid et al. | 208/48 Q |
| 5,166,428 | A | 11/1992 | Cole-Hamilton et al. | 562/899 |
| 5,211,834 | A | 5/1993 | Forester | 208/48 AA |
| 5,330,970 | A | 7/1994 | Reid et al. | 507/90 |
| 5,354,450 | A | 10/1994 | Tong et al. | 208/48 AA |
| 5,360,531 | A | 11/1994 | Tong et al. | 208/48 AA |
| 5,442,112 | A | 8/1995 | Cole-Hamilton et al. | 562/899 |
| 5,877,379 | A | 3/1999 | Wu et al. | 585/643 |
| 5,923,944 | A | 7/1999 | Coffinberry et al. | 428/551 |
| 5,954,943 | A | 9/1999 | Tong et al. | 208/48 R |

FOREIGN PATENT DOCUMENTS

| | | |
|---|---|---|
| GB | 275662 | 8/1928 |
| GB | 296752 | 9/1928 |

OTHER PUBLICATIONS

Atria, J.V. et al., (Mar. 1996) "Nature of High Temperature Deposits from *n*–Alkanes in Flow Reactor Tubes," *ACS Preprints, Petroleum chemistry* 493–497.

Baker, R.T.K. and Chludzinski, J.J., (1980) "Filamentous Carbon Growth on Nickel–Iron Surfaces: The Effect of Various Oxide Additives," *J. Catal.* 64:464–478—no month.

Baker, R.T.K. and Yates, D. J. C., (1982), "Filamentous Carbon Formation over Iron Surfaces," in Coke Formation on Metal Surfaces, ACS Symposium series 202, 1–21—no month.

Chen, F.F. et al., "Engineering Scale Titanium Endothermic Fuel Reactor Demonstration for a Hypersonic Scramjet Enginer," (1998) presented at 35$^{th}$ JANNAF Joint Combustion, Airbreathing Propulsion, and Propulsion Systems Hazards Subcommittees Meeting, Tucson, AZ, Dec. 7–11—no month.

Chowdhury, S.N. and Kunzru, D., (Dec. 1993) "Benzyl Diethyl Phosphite as a Coke Inhibitor during Naphtha Pyrolysis. Tubular Reactor Studies," *Can. J. Chem. Eng.* 71:873–879.

Das et al., (1992), "Organophosphorus Compounds as Coke Inhibitors during Naphtha Pyrolysis. Effect of Benzyl Diethyl Phosphite and Triphenylphosphine Sulfide," *Ind. Eng. Chem. Res.* 31:2251–2255—no month.

Ghosh, K.K. and Kunzru, D., "Sodium Silicate as a Coke Inhibitor during Naphtha Pyrolysis," (Apr. 1992) *Canadian J. Chem. Eng.* 70:394–397.

Marek, J.C. and Albright, L.F., (1982), "Surface Phenomena during Pyrolysis," in *Coke Formation on Metal Surfaces*, ACS Symposium Series 202, pp.151–175—no month.

Marek, J.C.and Albright, L.F., (1982), "Formation and Removal of coke Deposited on Stainless Steel and Vycor Surfaces from Acetylene and Ethylene," In Coke Formation on Metal Surfaces, ACS Symposium Series 202, pp. 122–149—no month.

Reyniers, G.C. and Froment, G.F., (1994) "Coke Formation in the Thermal Cracking of Hydrocarbons. 4. Modeling of Coke Formation in Naphtha Cracking," *Ind. Eng. Chem. Res.* 33:2584–2590—no month.

Vaish, S. and Kunzru, D., (1989) "Triphenyl Phosphite as a Coke Inhibitor during Naphtha Pyrolysis," *Ind. Eng. Chem. Res.* 28:1293–1299—no month.

Wickham et al., (Jun. 1999), "Additives to Reduce Coking in Endothermic Heat Exchangers," 35$^{th}$ *AIAA/ASME/SAE/ASEE Joint Propulsion Conference and Exhibit, Los Angeles*, CA.

Wickham, D.T. et al. (Nov. 1977), "Initiators for Endothermic Fuels," *10/97 JANNAF Combustion/JSM Meeting*.

*Primary Examiner*—Nadine Preisch
(74) *Attorney, Agent, or Firm*—Greenlee, Winner and Sullivan, P.C.

(57) ABSTRACT

Materials and methods for inhibiting the formation of filamentous coke on heated metal surfaces. Organoselenium compounds, including diarylselenides, diaryldiselenides, alkylarylselenides, and alkylaryldiselenides, are employed as hydrocarbon feedstock additives or as hydrocarbon fuel additives to inhibit filamentous coke formation on hydrocarbon processing systems, including reactors, furnaces, engines and parts thereof and in particular to inhibit filamentous coke formation on heat-exchangers in such systems.

33 Claims, 5 Drawing Sheets

METHODS FOR SUPPRESSION OF FILAMENTOUS COKE FORMATION

ACKNOWLEDGMENT OF GOVERNMENT FUNDING

This invention was made with funding from the United States government through Air Force Grant F33615-96-C-2626. The United States government has certain rights in this invention.

BACKGROUND OF THE INVENTION

This invention relates generally to the inhibition or prevention of coke formation on metal surfaces in contact with hydrocarbons at high temperatures. Such conditions can occur in hydrocarbon cracking processes and in certain types of engine systems in which hydrocarbon fuels reach very high temperatures. The invention more specifically relates to suppression of filamentous coke formation.

Carbon deposits (coke) can result from an interaction of the hydrocarbon processing stream and the metals contained in the walls and heat exchangers of reactors at temperatures above about 300° C. Deposits that form i n the shape of long filaments approximately 1 $\mu$m in diameter are referred to as filamentous coke. Non-filamentous coke can also form under pyrolysis conditions by several different mechanism. Filamentous coke is typically more abundant at higher temperatures (greater than about 450° C.), is hard and can be difficult to remove.

Coke formation is generally detrimental to the productivity and efficiency of the operation of a given system, causing fouling of lines and erosion of surfaces which increase operation down-time for cleaning and maintenance.

Filamentous coke formation is observed in naphtha cracking and ethylene production operations. The formation of coke in ethylene and naphtha reactors lowers product yield, heat transfer and reactor life along with the increased cost of time and money for decoking operations Froment, G. F., Reyniers, G. C., Kopinke, F., Zimmermann, G. (1994). *Ind. Eng. Chem. Res.*, V. 33, 2584 ). Much research on the formation of coke catalyzed by metal surfaces is based on attempts to solve these problems.

Coke formation is also a significant problem in engine systems in which the hydrocarbon fuel temperatures can reach levels greater than about 300° C. For example, hypersonic aircraft employ fuel to cool ramjet/scramjet propulsion system. In these systems, sensible heating and endothermic reactions can be used to provide the required heat sink, but in the process, the fuel temperature can reach 650° C. (1200° F.) or more. When fuel reaches these temperatures, carbonaceous deposits (coke), including filamentous coke, form on the walls of the heat exchangers. These deposits can inhibit fuel flow and reduce heat transfer across the heat exchanger surface.

Filamentous coke formation is sensitive to the type of metal used in reactor walls. Nickel and iron present on the metal surface, as occurs in nickel and/or iron alloys and various types of steel, for example, are believed to catalyze the formation of filamentous coke through the formation of metal carbides that decompose (Vaish, S. and D. Kunzru (1989) "Triphenyl Phosphite as a Coke Inhibitor During Naphtha Pyrolysis" *Ind. Eng. Chem. Res.* 28, 1293–1299 and Reyniers, G. C., Froment, G. F., Kopinke, F. D., and Zimmerman, G. (1994). "Coke Formation in the Thermal Cracking of Hydrocarbons. 4. Modeling of Coke Formation in Naphtha Cracking" *Ind. Eng Chem Res.*, 33, pp 2584–2590). Filamentous coke does not form in copper-lined reactors (Wickham, D. T., J. V. Atria, J. R. Engel, B. D. Hitch and M. E. Karpuk (1997). "Initiators for Endothermic Fuels," 10/97 JANNAF Combustion/JSM Meeting) and titanium metal is resistant to filamentous coke formation (Chen, F. F., Karpuk, M. E., Hitch, B. D., and Edwards, J. T. (1998), "Engineering Scale Titanium Endothermic Fuel Reactor Demonstration for a Hypersonic Scramjet Engine," presented at the 35th JANNAF Joint Combustion, Airbreathing Propulsion, and Propulsion Systems Hazards Subcommittees Meeting, Tuscon Ariz., December 7–11).

Significant effort has been expended to identify ways to passivate metal surfaces under high temperature pyrolysis conditions. The formation of metal oxide layers on alloys is reported to passivate the surface and reduce coking. One method is to oxidize the metal alloy with oxygen or steam to create an oxide layer such as chromia which is more resistant to carbon diffusion (Albright, L. F. and Marek, J. C. (1982) "Surface Phenomena During Pyrolysis," in *Coke Formation on Metal Surfaces*, ACS Symposium Series 202, 123). The use of alumina and silica coatings are also reported to create a barrier to carbon diffusion and reduced coke filament formation on metal surfaces (Albright, L. F. and Marek, J. C. (1982); Atria, J. V, H. H. Schobert, and W. Cermignani (1996). "Nature of High Temperature Deposits from n-Alkanes in Flow Reactor Tubes", *ACS Preprints, Petroleum Chemistry*, pp. 493–497; Baker, R. T. K. and Chludzinski, J. J. (1980). J Catal., V. 64, 464; Ghosh, K. K, and D. Kunzry (1992). "Sodium Silicate as a Coke Inhibitor During Naphtha Pyrolysis", *Canadian Journal of Chemical Engineering*, 70, pp. 394–397). The preparation of alumina coatings is difficult and requires the use of aluminum-containing metal alloys in processing equipment or engines. For example, an inert alumina surface layer can be formed on aluminum containing alloys such as Incoloy 800 by treating the alloy at temperatures above 1000° C. in a hydrogen atmosphere with a low partial pressure of water. Silica coatings are not very effective. Atria et al. (1996) observed cracking of silica layers allowing filaments to grow. Ghosh and Kunzru (1992) found that passivation with sodium silicate initially reduced the coke formation rate by about 50%, but that the beneficial effect was reduced each time a decoking step was employed. Further, repeated oxidation or sulfiding of metal surfaces or repeated decoking applications roughens metal surface increasing the surface area and leading to formation of larger amounts (Albright and Marek 1982). Polishing of alloy and metal surfaces has been indicated to help reduce coke formation.

Various additives have been reported to reduce coke formation. U.S. Pat. No. 1,847,095 reports "adding or supplying" metalloids including boron, arsenic, antimony, bismuth, phosphorous, selenium and silicon or compounds thereof "to the metallic (and non-metallic, if any) materials" which come into contact with "hydrocarbons at high temperature" to diminish or prevent coke and soot formation. The patent indicates that metal surfaces can be coated or treated with the substances or that "small quantities of the hydrogen compounds" of the metalloids may be added to hydrocarbons. The hydride of selenium, among others, is reported to be of high utility in this process. The patent specifically reports addition of 0.01%–0.05% of "hydrides of silicon" to an ethylene-hydrogen-carbon dioxide mixture. GB patents 275,662 and 296,752 relate to the same or similar processes.

Trimethyl- or triphenylphosphite and benzyldiethylphosphate are reported to decompose at 700° C. to form phosphorous compounds which passivate metal surfaces (Kunzru, D. and Chowdhury, S. N. (1993) *Can. J Chem. Eng.*, V. 71,873; Kunzru, D. and Vaish, S. (1989) *Ind. Eng. Chem. Res.*, V. 28, 1293; Vaish, S. and D. Kunzru (1989) *Ind. Eng. Chem. Res.* 28, 1293–1299). However, reductions in coke deposition of only 10–30% were reported. In addition, Vaish and Kunzru (1989) reported that high concentrations (up to 1000 ppm) of trimethyl- and triphenyl phosphites were required to achieve good (approximately 90%) reduction in coke formation. Further, when the additive was discontinued, the rate of coke formation increased and approached the rate measured when no additive was present.

U.S. Pat. No. 4,116,812 reports the use of organo-sulfur compounds to inhibit fouling at elevated temperatures in pyrolysis furnaces used to produce ethylene. U.S. Pat. Nos. 3,531,394; 4,024,050; 4,024,05; 4,105,540; 4,542,253; 4,835,332; 5,354,450; and 5,360,531 report the use of various phosphorous-compounds for coke suppression. U.S. Pat. No. 3,531,394 reports the use of bismuth-containing compounds for coke suppression. Tong and Poindexter U.S. Pat. No. 5,954,943 report that a mixture of sulfur and phosphorous compounds having a sulfur to phosphorous atomic ratio of at least 5:1 can be used to reduce coke formation. The mixture of compounds is used to pretreat the surfaces of a pyrolysis furnace for up to 20 hrs prior to introduction of hydrocarbon feed to generate a passivation layer. U.S. Pat. No. 4,551,227 reports the use of tin compounds, antimony compounds or both in combination with phosphorous compounds for suppression of coke formation.

Various patents report the use of chromium, tin and antimony (U.S. Pat. No. 4,863,892), combinations of tin and silicon, antimony and silicon, or tin, antimony and silicon (U.S. Pat. No. 4,692,234), and combinations of aluminum and antimony or aluminum, antimony and tin (U.S. Pat. No. 4,686,201) as effective antifouling agents in thermal cracking processes. In all cases, a test coupon consisting of Inconel 800 was immersed in solutions containing the specific metals cited and then heated in air to convert the metal to its oxide form. The coupon was exposed to a coking environment and then heated in steam, converting the coke layer to CO, which was measured by gas chromatography. Although the binary combination of additives suppressed CO formation in some cases, subsequent cycles showed increased coke formation.

U.S. Pat. Nos. 4,555,326; 4,729,064; and 4,680,421 report the use variously of boron, boron oxides, metal borides or ammonium borate to suppress coke formation in pyrolysis furnaces. U.S. Pat. Nos. 5,093,032, 5,128,023 and 5,330,970 report the use of a combination of boron compounds and a dihydroxybenzene compound for inhibiting coke formation. Coke reduction levels of up to 86% (measured in mg coked formed compared to controls) were reported when combination of ammonium biborate and hydroquinone (250 ppm/150 ppm) was added in coker feedstock in a cracking furnace.

U. S. Pat. Nos. 2,698,512; 2,959,915; and 3,173,247 relate to thermal degradation of hydrocarbon fuels at high temperatures to form gum and coke deposits. These patents report fuel compositions more stable to decomposition at high temperature that give lower levels of deposits. U.S. Pat. No. 5,923,944 reports surface treatment, including removing surface irregularities and deposition of a coating consisting essentially of a metal oxide (e.g., $Ta_2O_5$ or $SiO_2$) and the vapors of an organometallic compound, to avoid deposition of thermal decomposition products from hydrocarbon fuels.

While considerable efforts have been made toward identifying methods and additives for reducing coke formation from hydrocarbons under pyrolysis conditions, there is still a significant need in the art for reliable additives which provide high levels of coke suppression (about 90% or more) at low additive concentrations (less than about 100 ppm) and which are particularly effective for suppression of filamentous coke formation.

SUMMARY OF THE INVENTION

This invention relates to the reduction or prevention of coke formation and deposition on metal surfaces during hydrocarbon processing at high temperature. More specifically, the invention provides selenium additives and methods of using such additives for the reduction of filamentous carbon formation in furnaces or reactors for processing hydrocarbons or in engines that employ hydrocarbon fuels. The invention is particularly useful for reducing filamentous coke formation on iron and/or nickle-containing metal and/or alloy surfaces. The invention also relates to a method of pretreating metal surfaces to inhibit or prevent filamentous coke formation by contacting an appropriately heated metal surface with an additive of this invention. The invention is based on the identification of selenium additives, including organoselenium compounds, that inhibit or prevent coke formation and particularly inhibit filamentous coke formation. The organoselenium additives are believed to inhibit or prevent metal carbide formation, such carbides are intermediates in the formation of coke, particularly filamentous coke. The invention specifically relates to organoselenium additives that prevent or inhibit the formation of nickel and iron carbides which can be formed on furnaces, reactors and/or engine surfaces having steel parts (including, for example, carbon steel and stainless steel). Additives of this invention are believed to react with metal components in furnace, reactor or engine walls or parts thereof to generate metal compounds that are sufficiently stable that they do not undergo further reaction with fuel to form metal carbides.

Preferred selenium compounds of this invention are organoselenium compounds including without limitation, organoselenides (R—Se—R'), organodiselenides (R—Se—Se—R'), and organoselenols (R—Se—H), where R and R', may be the same or different, and are selected from aliphatic or aryl groups which may contain one or more heteroatoms.

The invention also provides improved hydrocarbon feedstock and hydrocarbons fuels which contain from about 0.01 ppm selenium to about 1000 ppm selenium as an organoselenium additive that is an inhibitor of filamentous coke formation. Compositions of this invention can comprise less than or equal to about 100 ppm selenium. More preferred feedstock or fuel compositions comprise levels of organoselenium inhibitors ranging from about 1 ppm to about 50 ppm. The improved feedstock and fuel compositions exhibit improvements in reduction or prevention of coke formation and particularly in reduction of filamentous coke formation. Feedstock and fuel compositions may include additional additives that are known to affect coke formation, and particularly any additional additives that reduce and/or inhibit non-filamentous coke formation.

The method and additives of this invention can be applied in any hydrocarbon processing system or engine where coke formation, particularly filamentous coke formation, occurs. Filamentous coke formation can be a significant problem for hydrocarbon processing under pyrolysis conditions (e.g. at high temperatures of 300° C. or more in the substantial absence of oxygen, i.e. at most about 0.1 atm. partial pressure of oxygen). The method and additives are useful in systems that are operated at ambient pressures or at pressures above ambient. The methods and additives are particularly well suited for use in pyrolysis furnaces (steam crackers or ethylene furnaces) used for hydrocarbon cracking, e.g., for the production of ethylene, and in engines or propulsion systems in which fuel can reach temperatures of 300° C. or more, e.g., in hypersonic aircraft engines. The method and additives of this invention are useful when the metal surface is about 650° C. as well as when the temperature of the hydrocarbon is about 800° C or more.

The additives described herein represent a significant improvement over the prior art. The additive is more effective for inhibition of filamentous coke formation at lower concentrations than other additives described previously. In addition, discontinuing additive injection, does not lead to increases in carbon deposition.

BRIEF DESCRIPTION OF THE FIGURES.

FIGS. 1A and B show the favored phases of iron and nickel, respectively, in large excess of a model hydrocarbon fuel at temperatures up to 900° C. FIG. 1C shows the favored phases of iron and nickel under the same conditions in the presence of 10 ppm selenium.

DETAILED DESCRIPTION OF THE INVENTION

This invention is based at least in part on the identification of organoselenium compounds that inhibit or prevent filamentous coke formation on metal walls in contact with hydrocarbons at high temperatures. Exposure of metal surfaces to low levels of organoselenium compounds provides selenium at the metal surface and results in inhibition or prevention of filamentous coke deposition on the surfaces. Surface selenium levels ranging upwards from about 10 atomic %, where atomic % is the ratio of atoms of selenium to total atoms in the outer one to two microns of metal substrate, as measured by Energy Dispersive Spectroscopy (EDS) techniques, provide a protective effect against filamentous coke formation.

A protective effect (a measurable decrease in filamentous coke formation) can be achieved by exposure of a metal surface to organoselenium compounds at levels ranging from about 0.01 ppm selenium to about 1000 ppm selenium for times ranging from minutes to hours. Protective effect is retained a significant time after exposure to the organoselenium compounds is ended (10's of hours to days). The level and duration of protective effect provided depends generally on the concentration of organoselenium compound, the duration of exposure, and the temperature. For example, one hour of exposure to diphenylselenide at 300 ppm provided significant reductions of 90% or more in filamentous coke formation for at least 12 hours in test reactors. Substantial reductions of 50% or more in filamentous coke formation for periods of 12 hrs or more of exposure to hydrocarbon feedstock or fuel provide practical levels of surface protection.

Without wishing to be bound by any particular theory, Applicants presently believe that organoselenium additives provide selenium to the metal surface to form metal selenides, e.g., iron and nickel selenides on steel, preventing the formation of the corresponding metal carbides, e.g., $Fe_3C$ and $Ni_3C$. Metal carbides have been implicated as intermediates in the formation of filamentous coke. Decomposition of metal carbides is believed to release unreactive carbon atoms which form carbon filaments at metal surfaces. The process is believed to be catalytic in that metal released from the metal carbide reacts with hydrocarbon to reform the carbide, decompose and release additional carbon atoms and metal to again form the carbide.

Figure 1A:
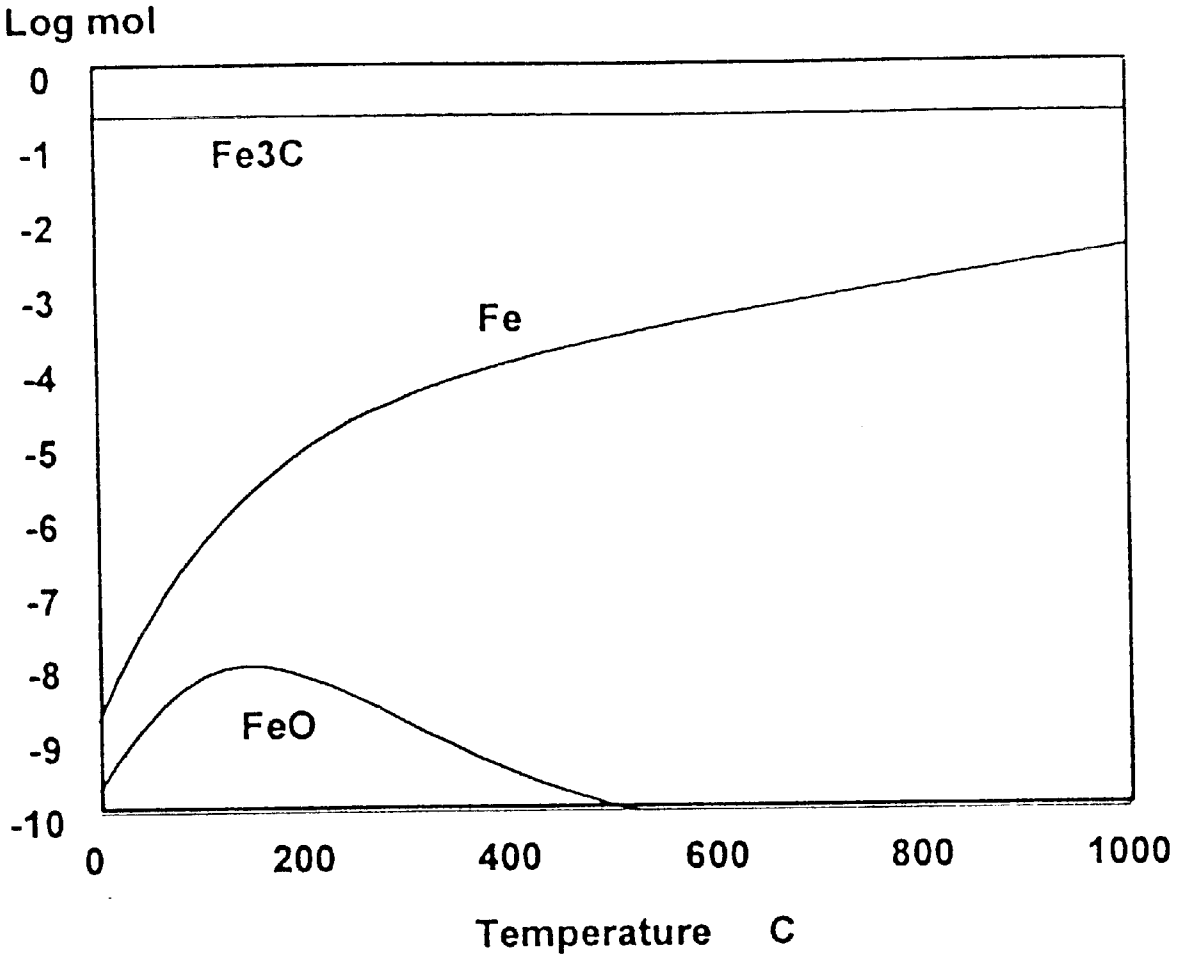
FIGS. 1A–C are graphs showing the results of thermodynamics calculations.

FIGS. 1A and B are graphs illustrating the results of a thermodynamics calculation of the thermodynamically favored phases that are present when iron (FIG. 1A) and nickel (FIG. 1B) are exposed to a large excess of n-heptane at a pressure of 35 atm and at temperatures up to 900° C.(1650° F.). The calculations illustrated were performed using a program that determines the forms of each element present in a system by applying routines that minimize the Gibbs Free Energy in a given system based on known thermodynamic data for given relative amounts of the elements present. HSC Chemistry thermodynamics modeling software (Outkumpu Research Oy, Pori, Finland) was specifically used. A low level of dissolved oxygen (70 ppm) was included in the calculation to better model experimental and real world fuel systems. Iron and nickel carbides are the favored forms under the high temperature reducing conditions modeled. The graphs also indicate that the corresponding metal phases will also be present.

Figure 1B:
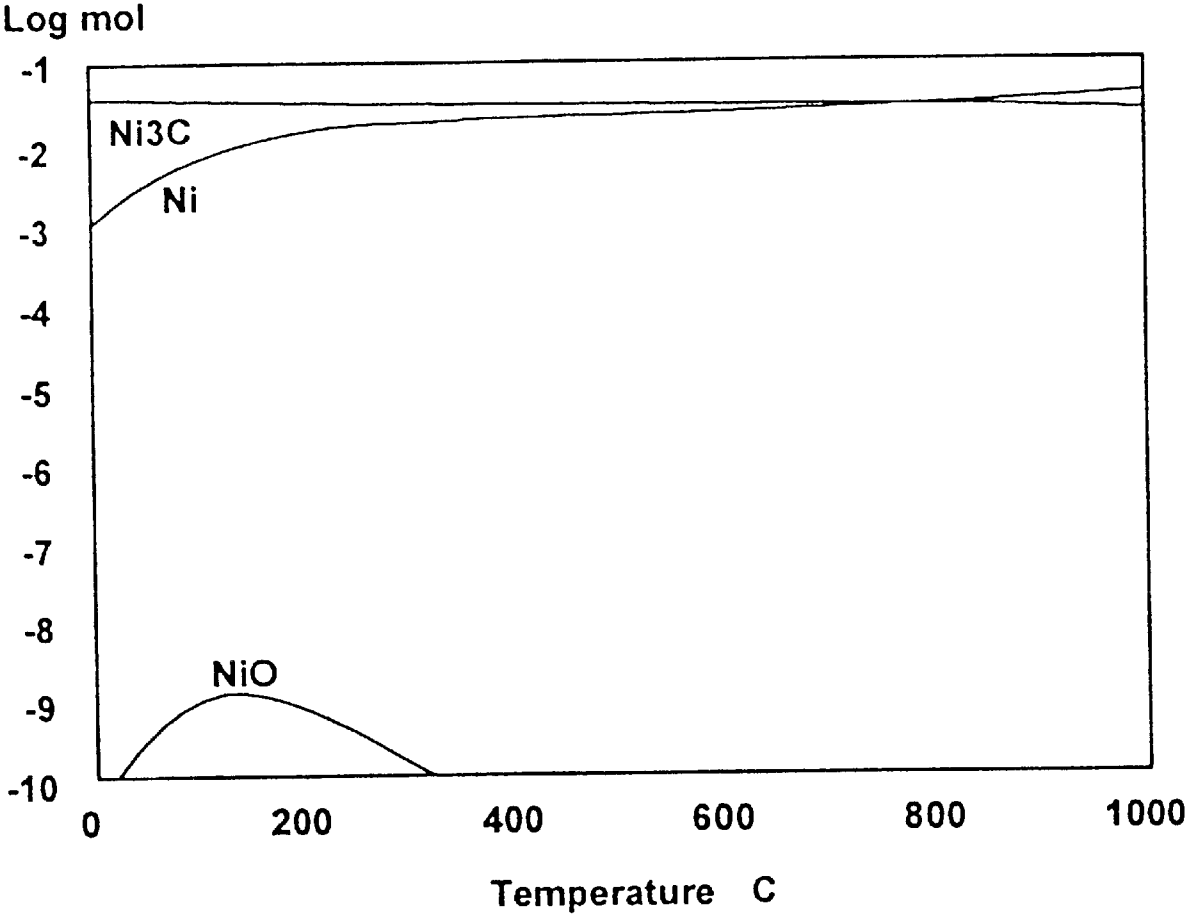
Figure 1C:
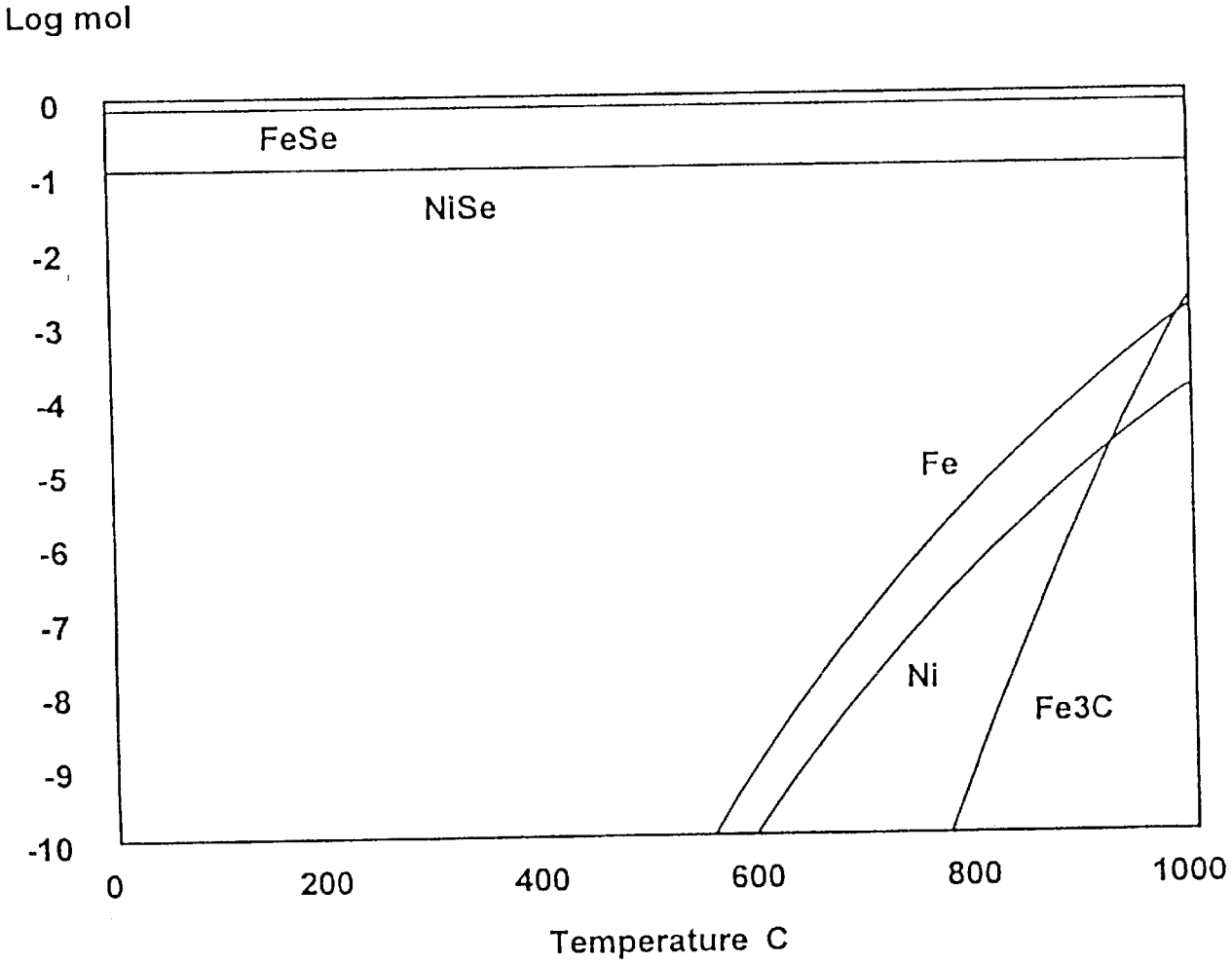

FIG. 1C is a graph illustrating the results of a similar thermodynamics calculation of favored phases, when a low level of selenium (10 ppm) is added to the model fuel containing 70 ppm of dissolved oxygen. Even at this low level of selenium and in the presence of a large excess of hydrocarbon, nickel and iron selenides are highly favored. Further, the metal selenides are favored over a wide temperature range. Only low levels of iron carbide are predicted at the highest temperatures. The high stability of the metal selenides effectively blocks the formation of metal carbides which are the favored phases in the absence of selenium.

The calculations illustrated in FIGS. 1A–1C are consistent with a mechanism of inhibition of coke formation by organoselenium based on the inhibition or prevention of metal carbide formation.

The methods of this invention involve contacting a metal surface susceptible to coke formation with an organoselenium compound. The metal surface is contacted with the organoselenium compound at a selected concentration for a selected time to provide a protective effect for the formation of coke. The method is particularly beneficial for prohibiting or inhibiting the formation of filamentous coke. Preferably, the metal surface is contacted with the organoselenium compound at a concentration level and for a duration that provides at least about a 50% decrease in filamentous coke deposition (compared to control processes in the absence of treatment with the organoselenium compound). More preferably, the organoselenium compound is provided to the metal surface at a concentration and for a time sufficient to result in at least about a 90% decrease in filamentous coke formation. For purposes of this invention, coke deposition is determined in test apparatus by weighing the amount of coke deposited on a metal surface or metal coupon exposed to hydrocarbon feedstock or fuel at high temperatures of 300° C. or more. The presence or absence of filamentous coke on a given metal surface can be assessed qualitatively by SEM analysis where the presence of carbon filament can be observed.

Metal surfaces that are susceptible to filamentous coke formation, include those which contain metals that will form carbides on interaction with hydrocarbons at high temperatures that will decompose to release carbon atoms. Surfaces of iron- or nickel-containing metals or alloys are benefitted by the methods of this invention. Iron-containing alloys, include without limitation, various steels (stainless steel, carbon steel, etc.). Nickel-containing alloys, include without limitation, high temperature alloys, such as Inconel and related alloys. Any metal or alloy which contains more than about 1% by weight nickel, iron or a combination of both that is used in equipment that comes into contact with hydrocarbon fuels or hydrocarbon feedstock at high temperatures is benefitted by the methods of this invention.

It is believed that the organoselenium additives of this invention inhibit metal carbide formation. Thus, the organoselenium additive is provided to the metal surface at a concentration and for a time sufficient to inhibit or prevent metal carbide formation. For purposes of this invention, metal carbide inhibition can be assessed by XRD methods to detect the presence of metal carbides in the outer 1–2 microns of the steel surface. A decrease in metal carbide on the metal surface directly correlates with a decrease in filamentous coke formation. XRD methods are applicable, for example, to the detection of the presence of iron carbide on metal surfaces that have been exposed hydrocarbons under pyrolysis conditions. The absence of iron carbide in XRD scans after exposure to organoselenium is indicative of a protective effect against filamentous coke formation.

Selenium can be detected on metal surfaces that have been exposed to organoselenium selenium additives of this invention, for example by EDS methods. Surface selenium levels of about 10 atomic % weight provide protective effect against filamentous coke formation. Surface levels of selenium of about 20 atomic %±10% are associated with significant reductions of 90% or more in filamentous coke deposition on stainless steel. Atomic % is the ratio of atoms of selenium to total atoms in the outer one to two microns of the metal substrate and is determined as noted in the examples and as known in the art by EDS methods.

The metal surfaces to be protected against coke formation can be contacted with organoselenium additives of this invention by introducing the additive into the hydrocarbon feedstock or fuel that is to be processed or used. The additive is introduced at levels ranging from about 0.01 ppm (of Se) up to about 1000 ppm (of Se) to provide protective effect. It is preferred to use the lowest level of additive that provides the desired level of protective effect at a given hydrocarbon processing temperature. The additive may be provided continuously, e.g., by simply adding a desired low level to the hydrocarbon before processing or use, or provided periodically, e.g., for a selected time after which addition is discontinued. Metal surfaces can be reexposed to additive periodically on a schedule that provides the desired protective effect. In hydrocarbon processing application, e.g., pyrolytic furnaces, the additive can be selectively added to the hydrocarbon feedstock stream prior to or during processing at high temperatures at a desired effective concentration for a desired effective duration.

The organoselenium additives of this invention are of particular benefit when employed in hydrocarbon processing under pyrolysis conditions (i.e., temperatures of 300° C. or more in the substantial absence of oxygen). The additives also provide particular benefit in engine systems employing hydrocarbon fuels which may contain low levels of dissolved oxygen, e.g., levels up to about 70 ppm dissolved oxygen.

Alternatively, metal surfaces that are to be protected can be pretreated with organoselenium compounds of this invention prior to exposure to hydrocarbons at high temperatures. Pretreatment can be performed using organoselenium compounds in an appropriate diluent or solvent. During pretreatment, the metal should be sufficiently hot to form the metal selenide on contact with the organoselenium compound. The metal surface is heated to a temperature of about 300° C. or more during pretreatment to form a metal selenide. Metal surfaces are preferably heated to a temperature of 500° C. or more during pretreatment. Although, not required, it is preferred that coke deposits are removed from the metal surfaces that are to be protected prior to pretreatment with organoselenium compounds of this invention.

Organoselenium compounds useful as additives include without limitation: organoselenides (R—Se—R'), organodiselenides (R—Se—Se—R'), and organoselenols (R—Se—H), where R and R', may be the same or different, and are selected from aliphatic or aryl groups which may contain one or more heteroatoms. Aliphatic groups include for example, straight-chain, branched or cyclic alkyl groups, alkenyl groups or alkynyl groups, which may be substituted with halogens, aryl groups, $OR^1$ or $NR^1R^2$ groups, where $R^1$ and $R^2$, independently can be H, aliphatic and/or aryl groups, or combinations thereof. Aliphatic groups include ethers, aldehydes, ketones and esters in which one or more $CH_2$ groups are replaced with O, CHO, CO, or COO moieties, respectively. Aliphatic groups can also contain siloxy and silylalkyl groups. Aryl groups include groups containing one or more 5- or 6-member aromatic rings, which may be fused, wherein the ring may contain one or two heteroatoms (non-carbon atoms, e.g., O, or N), and wherein the ring atoms may be substituted with aliphatic groups (as defined above), halogens, $OR^1$ or $NR^1R^2$ groups, where $R^1$ and $R^2$, independently can be H, aliphatic and/or aryl groups or combinations thereof. R and R' can be covalently linked together to form an aliphatic or aryl group. More specifically, organoselenium additives of this invention include, among others, diarylselenides, alkylarylselenides, dialkyselenides, diaryldiselenides, alkylaryldiselenides and dialkyldiselenides. Preferred additives are those which reduce, inhibit or prevent filamentous coke formation and which also do not generate substantially amounts of non-filamentous coke. Preferred organoselenium compounds of this invention are diarylselenides and diaryldiselenides.

A number of organoselenium compounds are known in the art and are readily available from commercial sources or by synthesis using art known methods. Strem Chemicals and Aldrich Chemicals (as illustrated in their published catalogs for 1999 and 2000 and in their current on-line catalogs) are commercial sources for a number or organoselenium compounds which are suitable for use as additives in the methods of this invention. Exemplary commercially available organoselenium additives are listed in Table 1. Preferred organoselenium compounds for use as additives are those that are soluble in the hydrocarbon feedstock or hydrocarbon fuel. Preferred organoselenium compounds for use as additives are those that are liquid at ambient temperatures and pressure to facilitate handling. Further, preferred organoselenium compounds are those which do not themselves generate large amounts of non-filamentous coke. In this regard, organoselenium compounds having at least one aryl group are preferred.

Methods for preparation of organoselenium compounds are disclosed for example in U.S. Pat. Nos. 4,003,829; 4,962,207; 5,026,846; 5,166,428; and 5,442,112. These methods and other art-known methods can be used, or readily adapted without expense of undue experimentation to synthesize organoselenium compounds for use as additives in the methods and compositions of this invention.

The methods and additives of this invention are employed to inhibit or prevent filamentous coke formation on metal surfaces on interaction with hydrocarbon feedstock or hydrocarbon fuels. Hydrocarbon feedstocks include any mixture of hydrocarbons that is to undergo some type of processing, e.g., cracking, at elevated temperatures, which are typically greater than about 300° C. Feed stocks are often mixtures of high molecular weight hydrocarbons that include species such as paraffins, olefins, aromatics, cycloparaffins, among many others. The molecular weight range of hydrocarbons in hydrocarbon feedstocks generally range from about $C_8$–$C_{20}$.

Hydrocarbon fuels include any hydrocarbon mixtures useful as fuel and particularly those useful in systems in which the fuel can have a temperature greater than about 300° C. Fuels are also a complex mixture of hydrocarbons, typically ranging in molecular weight from $C_{10}$ to $C_{18}$, which may include paraffins, olefins, aromatics, cycloparaffms, among many other species.

Hydrocarbon fuels may contain additional additive (other than organoselenium compounds) to improve fuel performance. Additives may include lubricity agents and additives to improve thermal stability of the fuel components.

TABLE 1

Exemplary List of Commercially Available Organoselenium Compounds Useful as Additives for Filamentous Coke Suppression

| | |
|---|---|
| (Phenylselenomethyl) trimethylsilane | benzeneselenol |
| 1,1 dimethyl-2-selenourea | benzyl selenide |
| 2,5 diphenyl-selenophene | di-tert-butyl selenide |
| 2-methylbenzenoselenazole | dibenzyl diselenide |
| 3-methyl-9H-selenoxanthen-9-one | dimethyl diselenide |
| 2-benzamidoethyl selenide | methyl phenyl selenide |
| benzeneseleninic acid | phenyl selenocyanate |
| benzeneseleninic acid anhydride | selenophene |
| benzeneseleninic anhydride | allyl phenyl selenide |

THE EXAMPLES

A model hydrocarbon fuel (n-heptane) was used to test the effect of addition of organoselenium compounds on coke formation. An automated test rig that has been described previously (Wickham et a. 1997, Wickham et al. 1999) was used to carry out the experiments. This apparatus is capable of flowing fuel at well-controlled rates at pressures up to 60 atm through test sections maintained at temperatures up to 700° C. The model fuel was heated to temperatures where cracking occurs and coke deposition was assessed with and without organoselenium additive. Diphenylselenide (available from Strem Chemicals) was the organoselenium compound tested. Diphenylselenide is a liquid under ambient conditions and is soluble in n-heptane. Test hydrocarbon fuel solutions were prepared by dissolving the appropriate volume of additive into the n-heptane reservoir prior to testing.

In the first set of tests, the amount of coke that accumulated in a stainless steel tube during pyrolysis with and without additive present was measured. In each test, a previously unused test section made from a 45 cm length of 0.64-cm OD×0.46 cm ID 316 stainless steel tube was weighed and then installed into the automated test apparatus. Test fuel compositions were flowed through the reactor maintaining a pressure of 37 atm and a flow rate of 2.9 ml/min (liquid hourly space velocity of 35 $h^{-1}$). A tube furnace with a heated zone of 30 cm enclosed the test section and heated the fuel from 400° C. at the inlet to the desired test temperature. In the first set of tests, a temperature of 655° C. was maintained as measured by a thermocouple spot-welded to the wall of the test section at the end of the heated zone.

In addition, during each test, the product distribution exiting the test reactor was measured using a Model 8600 SRI gas chromatography (GC) equipped with a thermal conductivity detector and a 90 cm column packed with silica gel. The test conditions used in the test reactor resulted in a measured cracking level of between 65 and 70%, where percent cracking is defined as (moles carbon in products/total moles carbon)*100. A mixture of methane, ethane, ethylene, propane, propylene, butane and butylenes and small amounts of $C_5$ and $C_6$ paraffins and olefins were observed to be the products of the cracking reaction. At the conclusion of a test period, the reactor temperature was reduced to 400° C., a nitrogen purge flow was initiated through the reactor, the flow of test fuel composition was discontinued and the reactor was cooled to ambient temperature. This sequence prevented coke formation during the shutdown, which might occur if the fuel flow was stopped while the reactor temperature was 655° C. After the test section was cool, it was removed from the apparatus, dried at 110° C. for four hours, and weighed to determine the quantity of carbon that had accumulated during the test. In one experiment, the reactor was maintained at temperature for six hours with a flow of test fuel composition (n-heptane) with and without an additive concentration of 300 ppm (of Se) (885 $\mu$g diphenylselenide/g fuel). In a second experiment, the test conditions were maintained for 12 hours and two different concentrations of additive (diphenylselenide at 300 and 30 ppm (of Se)) were examined.

Figure 2:
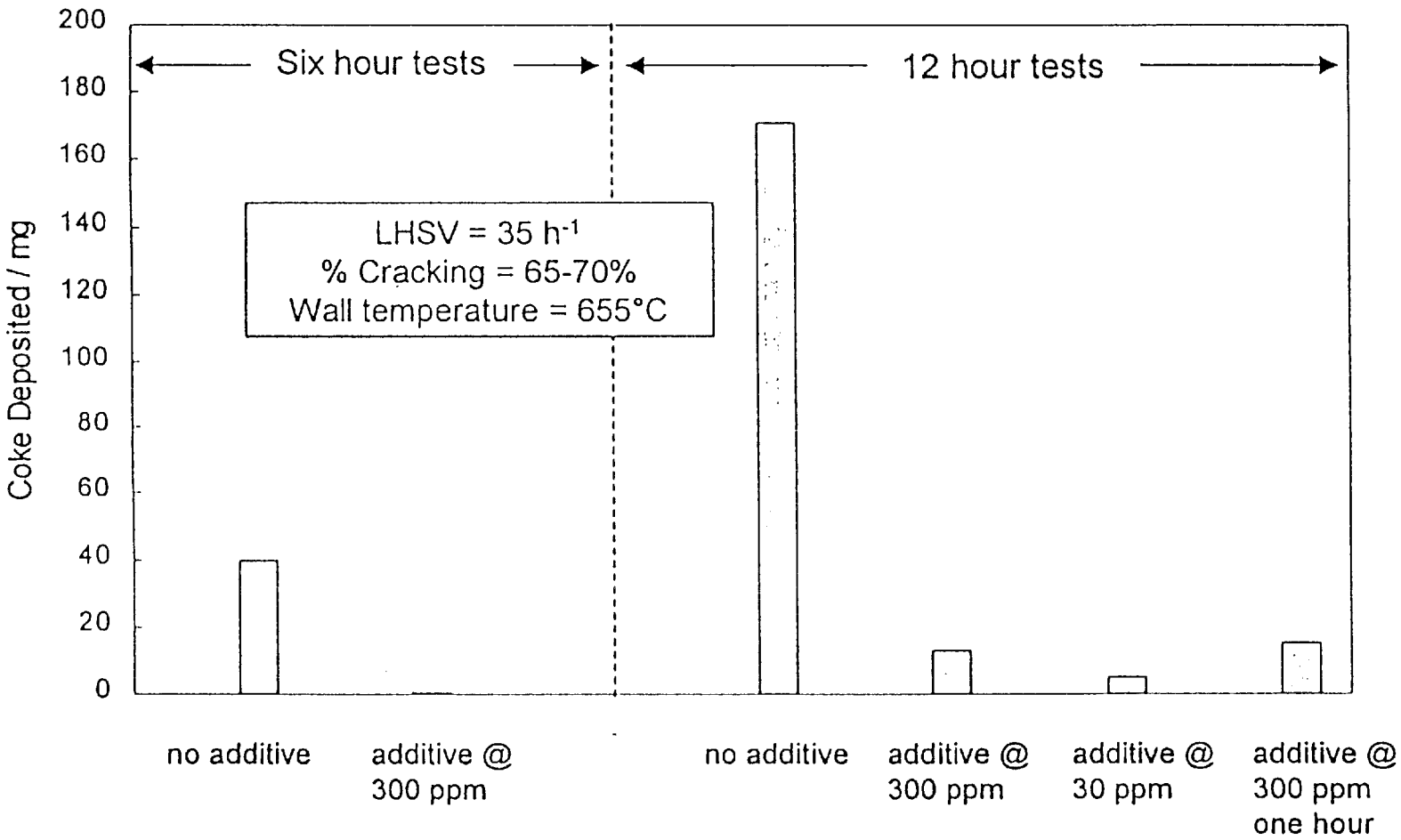
FIG. 2 is a bar graph showing the results of coke deposition experiments with and without diphenylselenide additive.

FIG. 2 illustrates and compares the results of experiments performed for 6 hrs (left) and 12 hrs (right). This figure is a bar graph of weight (in mg) of carbon deposited inside a reactor tube section as a function of experiment duration (6 hrs or 12 hrs) with and without an additive. In the 6 hour test, 40 mg of carbon accumulated inside the reactor tube (far left bar) during reaction to the model fuel. When 300 ppm (Se) of diphenylselenide is added less than 1 mg of carbon accumulates inside the tube. This represents over a 98% reduction in coke deposition. In the 12-hr test, 171 mg of carbon accumulated inside the tube (right side of FIG. 2) during reaction of the model fuel. Addition of 300 ppm (Se) diphenylselenide to the model fuel reduced carbon accumulation to 13 mg, a 93% reduction in coke formation. Scanning electron microscopic (SEM) analysis of the carbon deposited when no additive was present indicated that the coke formed was comprised of filaments approximately 0.5 to one micron in diameter (filamentous coke). SEM analysis of the carbon formed when the additive was present in the model fuel, showed that it had a different morphology and contained no carbon filaments. In view of this result, it appears that addition of the additive substantially suppressed the formation of filamentous coke. In all experiments, the SEM was operated at 10,000× with a resolution (i.e., smallest visible dimension) of about 0.1 micron.

To investigate the possibility that the small amount of carbon deposited with the additive was from the additive itself, the additive concentration was reduced to 30 ppm(of Se), a factor of ten lower than the previous test. Only 5 mg of carbon accumulated in the tube (over a 12-hr run), representing a 97% reduction in coke formation.

Another experiment was performed to assess whether or not continuous addition of the additive was required. In this case, the diphenylselenide additive was injected into the model fuel at a concentration of 300 ppm (of Se) for the first hour of the test only. The test was then continued for 12 hrs with fuel containing no additive. Only 13 mg of carbon accumulated under these conditions as shown in the far right bar in FIG. 2. SEM analysis showed no indication of carbon filaments in the small quantity of carbon accumulated. These results indicate that pretreatment of a reactor with an additive for a relatively short time (compared to the run time of the process) will provide high levels of inhibition of coke formation.

A second series of tests was carried out in which the effect of the diphenylselenide on stainless steel coupons, placed inside the test section during pyrolysis was examined. For these tests, a copper-lined reactor tube was used to eliminate carbon formation on the reactor tube wall. At the conclusion of each test, the test coupon was removed from the reactor energy dispersive spectroscopy (EDS) and x-ray diffraction (XRD) were performed to characterize the coupon surface. EDS provides qualitative data on the composition of a metal surface, and XRD provides information on crystalline compounds that form at depths of up to several microns.

Figures 3A, 3B, 3C:
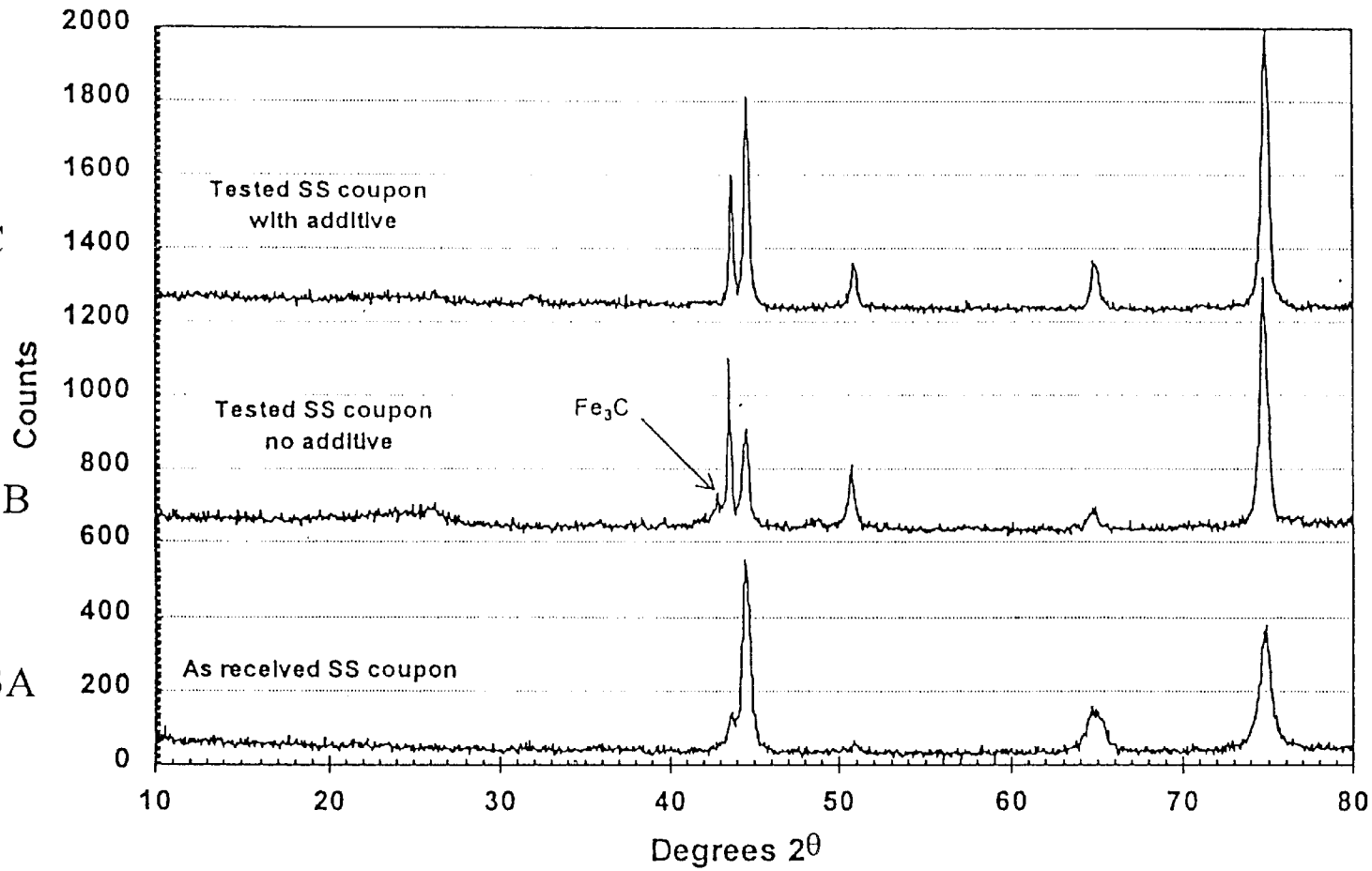
FIG. 3 illustrates a comparison of X-ray Diffraction (XRD) scans of stainless steel coupons. Scan A is a control coupon as received. Scan B is a test coupon after exposure to model hydrocarbon fuel (n-heptane) for 12 hrs in a test reactor at 655° C. Scan C is a test coupon after exposure to model hydrocarbon fuel for 12 hrs in a test reactor at 655° C. with diphenylselenide present in the fuel at a level of 300 ppm of selenium.

FIG. 3 illustrates XRD patterns obtained on three coupon samples: an as-received sample (A), a coupon used in a test with no additive (B), and a sample used in a test in which 300 ppm (Se) diphenylselenide was added to the fuel (C). On the as received sample a small peak at a 2θ value of 43.8° and a larger peak at 44.5° are observed. Peaks at 51°, 65° and 75° are also observed. These peaks are consistent with the presence of iron, chromium, and nickel contained in the 316 stainless steel alloy. The XRD pattern for the coupon tested with no additive, which produced filamentous coke, shows some significant changes in the diffraction pattern (B). In this pattern, a small peak appears at 42.8°. The location of this peak is consistent with the formation of iron carbide, $Fe_3C$, (International Center for Diffraction Data, 1995) and supports the idea that iron carbide is an intermediate in the filamentous coke formation process. This scan also shows changes in the intensities of the peaks associated with the steel components. The observed changes are likely due to the annealing effect caused by the exposure to high temperature. Finally, the scan C shows the XRD pattern obtained for the coupon tested with diphenylselenide (300 ppm selenium) in which no carbon filaments formed. This pattern shows no evidence of the small peak at 42.8°, indicating that no $Fe_3C$ was formed during this test. This result indicates that the selenium additive reacts with iron and nickel preventing the formation of iron and nickel carbides and as a result preventing the formation and deposition of filamentous coke.

EDS measurements on the surfaces of the coupons and on the inside surface of a stainless steel test section following a 12-hr test with model fuel containing the organoselenium additive indicate that selenium is present on the surfaces. For example, after 12-hr exposure to the additive, the selenium concentration on the coupon surface was approximately 18 atomic %±10%. A similar EDS measurement on the inside surface of the stainless steel tube after the test in which the selenium additive was injected only for the first hour of the 12-hr test and then continued with no additive present indicated about the same level of selenium on the inside surface (approximately 20 atomic %±10%) of the tube. Selenium is thus present at a high concentration (greater than or equal to about 10 atomic %) on the metal surface of the reactor even after 12 hours of operation without additive. This demonstrates that selenium is bound very strongly, likely with iron and nickel components of the stainless steel. These indicate that selenium at levels ranging from greater than or equal to about 18 atomic % on a metal surface, particularly a steel surface, provide for inhibition or prevention of filamentous coke formation. Further, the results indicate that protective levels of selenium on metal surfaces can be provided by exposure of the surfaces to low levels of organoselenium compounds (down to 1 ppm selenium) for relatively short times (1–6 hrs). The use of low levels of organoselenium compounds is preferred to reduce cost and any hazards associated with the use of the additive.

Those of ordinary skill in the art will appreciate that procedures, techniques, additives, reactors and hydrocarbon mixtures and fuels other than those specifically disclosed herein can be employed in the practice of this invention. For example, a number or organoselenium compounds are known and available in the art and can be used in the practice of this invention.

All references cited in this specification are incorporated by reference herein in their entirety to the extent that they are not inconsistent with the disclosures herein.

We claim:

1. A method for inhibiting the formation of coke on a metal surface in contact with a hydrocarbon which comprises the step of contacting the metal surface with an amount of an organoselenium compound effective for inhibition of metal carbide formation prior to or at the same time as contacting the metal surface with the hydrocarbon.

2. The method of claim 1 wherein the metal surface is a metal or alloy containing iron or nickel or both.

3. The method of claim 1 wherein the organoselenium compound is introduced into the hydrocarbon at a level between about 0.01 ppm selenium and 1000 ppm selenium with respect to the hydrocarbon.

4. The method of claim 1 wherein the organoselenium compound is introduced into the hydrocarbon at a level between about 1 ppm selenium and 1000 ppm selenium with respect to the hydrocarbon.

5. The method of claim 1 wherein the organoselenium compound is introduced into the hydrocarbon at a level less than or equal to about 100 ppm selenium.

6. The method of claim 1 wherein the organoselenium compound is introduced into the hydrocarbon at a level less than or equal to about 10 ppm selenium.

7. The method of claim 1 wherein the organoseleium compound is selected from the group consisting of a dialkylselenide, a diarylselenide, a dialhyidiselenide, a diaryldiselenide, an allylarylselenide, and alylaryldiselenide, an alkiylselenol and an arylselenol.

8. The method of claim 1 wherein the organoselenium compound is diphenylselenide, diphenyldiselenide, dibenzylselenide, or benzylselenol.

9. The method of claim 1 wherein the organoselenium compound is a dialkylselenide, a diarylselenide or an alkylarylselenide.

10. The method of claim 1 wherein the organoselenium compound is introduced into the hydrocarbon at a selected concentration for a selected time.

11. The method of claim 1 wherein the metal surface is heated to temperatures of 300° C. or more.

12. The method of claim 1 wherein the metal surface is heated to at least about 300° C. and is contacted with the organoselenium compound prior to contact of the metal surfaces with the hydrocarbon.

13. The method of claim 1 wherein the metal surface comprises steel.

14. The method of claim 1 wherein the metal surface comprises iron, nickel or both.

15. The method of claim 1 wherein the metal surface is a wall, heat exchanger or both of a pyrolysis furnace.

16. The method of claim 1 wherein the metal surface is a heat exchanger surface in a propulsion system.

17. The method of claim 1 wherein the metal surface is a wall or heat exchanger coil in a hydrocarbon cracking furnace.

18. The method of claim 1 wherein the hydrocarbon is a hydrocarbon feedstock for ethylene production.

19. The method of claim 1 wherein the hydrocarbon is a hydrocarbon fuel.

20. The method of claim 1 wherein the temperature of the metal surface is about 650° C.

21. The method of claim 1 wherein the temperature of the hydrocarbon is about 800° C. or more.

22. The method of claim 1 in which filamentous carbon formation is inhibited.

23. A method for pretreating a metal surface that is susceptible to filamentous coke formation which comprises the steps of:

a. heating the metal surface to a temperature that is sufficiently hot to generate metal selenides; and b. contacting the heated metal surface with an organoselenium compound to generate metal selenides.

24. The method of claim 23 wherein the metal surface is heated to a temperature of about 300° C. or more.

25. The method of claim 23 wherein the metal surface is heated to a temperature of about 500° C. or more.

26. The method of claim 23 wherein the organoselenium compound is selected from the group consisting of a dialkylselenide, a diarylselenide, a dialkyldiselenide, a diaryldiselenide, and allylarylselenide, and alkylamyldiselenide, an alkylselenol and an arylselenol.

27. The method of claim 1 wherein the metal surface is a surface of a hydrocarbon processing system or an engine.

28. The method of claim 1 wherein the hydrocarbon is a hydrocarbon feedstock.

29. The method of claim 1 wherein the metal surface, prior to contact, comprises coke deposits, wherein the contacting step also removes said coke deposits.

30. The method of claim 1 wherein the contacting step occurs continuously.

31. The method of claim 1 wherein the contacting step is repeated periodically.

32. The method of claim 10 wherein the organoselenium compound is introduced periodically.

33. The method of claim 1 wherein the contacting step occurs for a period of time between minutes to hours.

* * * * *

UNITED STATES PATENT AND TRADEMARK OFFICE

CERTIFICATE OF CORRECTION

PATENT NO. : 6,482,311 B1
DATED : November 19, 2002
INVENTOR(S) : Wickham et al.

It is certified that error appears in the above-identified patent and that said Letters Patent is hereby corrected as shown below:

Title page,
Item [56], References Cited, OTHER PUBLICATIONS, in the "Chen" reference, please replace "Enginer" with -- Engine --.

Column 1,
Line 24, please replace "i n" with -- in --.
Line 26, please replace "mechanism" with -- mechanisms --.
Line 48, please replace "system" with -- systems --.

Column 2,
Line 45, please replace "surface" with -- surfaces --.

Column 3,
Line 15, please delete "4,024,05".
Line 52, please insert -- a -- prior to "combination".

Column 4,
Line 17, please replace "nickle" with -- nickel --.
Line 46, please replace "hydrocarbons" with -- hydrocarbon --.

Column 7,
Line 43, please replace "substantially" with -- substantial --.

Column 9,
Line 23, please replace "cycloparaffms" with -- cycloparaffins --.
Line 48, please replace "a." with -- al. --.

Column 10,
Line 43, please replace "reaction to" with -- reaction of --.

Column 11,
Line 19, please insert -- and -- after "reactor".

UNITED STATES PATENT AND TRADEMARK OFFICE

CERTIFICATE OF CORRECTION

PATENT NO. : 6,482,311 B1
DATED : November 19, 2002
INVENTOR(S) : Wickham et al.

It is certified that error appears in the above-identified patent and that said Letters Patent is hereby corrected as shown below:

Column 12,
Line 3, please insert -- results -- after "These".
Line 17, please replace "number or" with -- number of --.
Line 46, please replace "organoseleium" with -- organoselenium --.
Line 48, please replace "dialhyidiselenide" with -- dialkyldiselenide --.
Line 49, please replace "allylarylselenide" with -- alkylarylselenide -- and "and" with -- an --.
Line 50, please replace "alylaryldiselenide" with -- alkylaryldiselenide -- and "alkiylselenol" with -- alkylselenol --.

Column 14,
Line 8, please replace "and" with -- an -- (both occurrences) and "allylarylselenide" with -- alkylarylselenide --.
Line 9, please replace "alkylamyldiselenide" with -- alkylaryldiselenide --.

Signed and Sealed this

Eleventh Day of March, 2003

JAMES E. ROGAN
*Director of the United States Patent and Trademark Office*